US006178633B1

(12) United States Patent
Yamane

(10) Patent No.: US 6,178,633 B1
(45) Date of Patent: Jan. 30, 2001

(54) VANE AND METHOD FOR PRODUCING SAME

(75) Inventor: Fujio Yamane, Tottori-ken (JP)

(73) Assignee: Hitachi Metals, Ltd., Tokyo (JP)

( * ) Notice: Under 35 U.S.C. 154(b), the term of this patent shall be extended for 0 days.

(21) Appl. No.: 09/399,184

(22) Filed: Sep. 20, 1999

Related U.S. Application Data

(62) Division of application No. 08/956,791, filed on Oct. 23, 1997, now Pat. No. 6,015,279.

(30) Foreign Application Priority Data

Nov. 15, 1996 (JP) ..... 8-304688

(51) Int. Cl.[7] ..... B21D 53/78
(52) U.S. Cl. ..... 29/889.7; 29/888.025
(58) Field of Search ..... 29/889.7, 888.025; 418/259

(56) References Cited

U.S. PATENT DOCUMENTS 4,174,931 11/1979 Ishizuka .
5,031,313 * 7/1991 Blair et al. ..... 29/889.7
5,577,321 * 11/1996 Brown et al. ..... 29/889.6

FOREIGN PATENT DOCUMENTS 58206893 12/1983 (JP) .
2308993 12/1990 (JP) .

* cited by examiner

*Primary Examiner*—Igida Rosenbaum
(74) *Attorney, Agent, or Firm*—Sughrue, Mion, Zinn, Macpeak & Seas, PLLC

(57) ABSTRACT

The vane 1 is substantially in a flat rectangular parallelepiped shape having (a) two wide side surfaces 1*c*, 1*c*' opposing in the thickness direction and being slidable in each guide groove 12 of a rotor 11 of an actuator, (b) two narrow side surfaces 1*d*, 1*d*' opposing in the width direction, (c) an as-cold-worked top surface 1*a* having an arcuately projecting cross section in a plane perpendicular to the width direction and being in slidable contact with a cam surface 14 of the actuator 13 for sealing, and (d) a bottom end surface 1*e* opposing the top surface 1*a*, both ends of said top surface 1*a* in the width direction being bulging toward the cam surface 14.

5 Claims, 8 Drawing Sheets

VANE AND METHOD FOR PRODUCING SAME

This is a divisional of application Ser. No. 08/956,791 filed Oct. 23, 1997, the disclosure of which is incorporated herein by reference, now U.S. Pat. No. 6,015,279.

BACKGROUND OF THE INVENTION

The present invention relates to a vane for use in various displacement-type actuators and a method for producing the vane.

The operation of a vane actuator exemplified by a hydraulic vane pump is first explained referring to FIG. 8. In this vane pump which may be used as a hydraulic motor as it is, a rotor 11 is fixed to a shaft 22 and rotatable in a closed space defined by a cam ring 13 and a pair of side blocks (not-shown) fluid-tightly fixed to both side ends of the cam ring 13. A member such as the cam ring 13 which is brought into contact with the rotor 11 may sometimes be called "contact member" herein.

Each vane 1 is substantially in a flat rectangular parallelepiped shape, both wide side surfaces thereof being slidably guided in a radial groove 12 of the rotor 11, and both narrow side surfaces thereof being slidably guided along inner surfaces of the side blocks. The rotor 11 rotates together with the vanes 1 in the direction shown by the arrow 20. During the rotation of the rotor 11, a top surface 1*a* of each vane 1 is always pressed into contact with a cam surface 14 of the cam ring 13 by a centrifugal force, a spring force, an outward force exerted by a pressurized hydraulic fluid entering into a space between the vane 1 and the radial groove 12 of the rotor 11.

Each pump room 15 defined by the rotor 11, the adjacent vanes 1, the cam surface 14 of the cam ring 13 and the side blocks has a volume variable depending on the rotation of the rotor 11, with the maximum volume at upper left and lower right positions and the minimum volume at lower left and upper right positions in FIG. 8. Accordingly, the hydraulic fluid is sucked into the pump room 15 through intake ports 16, 16 provided in the side block and discharged from the pump room 15 through discharge ports 17, 17 provided in the side block.

The top surface 1*a* of the vane 1 which is in slidable contact with the cam surface 14 is arcuately or roundly projecting, such that good sealing is always kept between the vane 1 and the cam surface 14 regardless of a relative angle of the vane 1 to the cam surface 14. Therefore, it has conventionally been considered that the arcuately projecting or round top surface 1*a* of the vane 1 should have high precision in dimension, straightness and surface roughness.

To achieve high precision in dimension and surface roughness, the top surface 1*a* of the vane 1 has conventionally been ground by a creep feed grinding wheel 9 as shown in FIG. 9, which has a grinding groove 9*a* formed on a circumferential surface by a dressing tool. The grinding wheel 9 is moved back and forth while rotating along the top surface 1*a* of the vane 1 in the direction perpendicular to the plane of the paper presenting FIG. 9. Though this grinding method can provide the round top surface 1*a* of the vane 1 with high precision in straightness and surface smoothness, it is a time-consuming process poor in efficiency, making the total production cost of the vanes high.

In view of these facts, methods of producing vanes without creep feed grinding have been proposed.

Japanese Patent Laid-Open No. 58-206896 discloses a method for producing a vane comprising the steps of subjecting a flat bar having a round surface at a top end to a normalization treatment; cutting the flat bar to a predetermined length to provide a vane; hardening the vane by a heat treatment; grinding surfaces of the vane to predetermined dimensions except for the round top surface to provide a vane having a predetermined cross section; assembling the resultant vanes into a vane pump such that the round top surface of each vane is pressed onto a cam surface of a cam ring; and carrying out a running-in operation of the vane pump to wear away a decarburized layer formed on the round top surface of each vane in the normalization step, such that the top surface of the vane is provided with a shape adapted to the cam surface of the cam ring. However, this method is not usable because it generates a large amount of wear dust which causes various troubles.

Japanese Patent Laid-Open No. 2-308993 discloses a method for producing a vane by plastic working such as drawing or extruding. As shown in FIGS. 11(*a*), 11(*b*), both side surfaces 30*c*, 30*c*' of a flat bar 30 are rolled by a pair of rolls 21, 22 having circumferential grooves 23, 24. Each of the circumferential grooves 23, 24 has a flat bottom surface 23*a*, 24*a*, a pair of rounded corners 23*b*, 23*c*, 24*b*, 24*c* to impart to the flat bar 30 flat side surfaces 30*c*, 30*c*', a rounded top surface 30*a* and a chamfered bottom end surface 30*b*. Because of rolling in the thickness direction, however, high precision in shape, straightness and surface smoothness cannot be achieved in the top surface 30*a* of the flat bar 30. As a result, the resultant vane fails to provide sufficient sealing without finish-grinding of a top surface.

Like the above two methods, vanes have been produced from flat bars which are cut to predetermined length by band saws, grinders, presses (shearing), etc., at a proper production stage. These cutting methods, however, are insufficient in cutting precision in length, surface roughness, scars, straightness, rectangularity, etc. In the case of shearing, the cross-sectional shape of the resultant vane may inevitably be distorted at cut ends, making it necessary to shear-cut the flat bar with a proper margin which is then removed by finish-grinding. Thus, the cutting method and the subsequent finish-grinding are also important factors determining the production cost of the vanes.

To improve the overall efficiency of an actuator, it is important to decrease friction between the vane and the cam ring while suppressing leaks. For this purpose, the vanes and the cam ring should have sufficiently precise dimension with minimum surface roughness. Since an inner surface of the cam ring is usually ground by a small-diameter grinding wheel supported by a projected shaft, the precise grinding of the inner surface of the cam ring cannot be carried out efficiently. The cam ring receives larger grinding pressure in an inner portion than in both opening (edge) portions from the grinding wheel, leading to larger grinding in both edge portions of the cam ring. As a result, a slight taper is inevitably formed in a ground inner surface of the cam ring within a range of about 0.5 mm from each opening of the cam ring.

The vane is usually barrel-finished, leaving a droop in a round top surface of the vane within a range of about 0.1 mm or more from the end thereof. Accordingly, when these vanes are assembled with the cam ring, leaking of a hydraulic fluid inevitably takes place because of the gap between the droops of the vanes at both ends of their round top surfaces and the tapered opening ends of the cam ring in its inner surface.

OBJECT AND SUMMARY OF THE INVENTION

Accordingly, an object of the present invention is to provide a vane adapted to be in a slidable contact with a contact member which may have drooping to some extent, without suffering from the leaking of a hydraulic fluid.

Another object of the present invention is to provide a method for producing such a vane at a low cost.

In view of the fact that drooping or tapering is unavoidable in the contact member such as a cam ring, the inventor has come to the conclusion that the top surface of a vane should be in an arcuate or round projection shape with small upward bulging at both ends to compensate for the drooping of the contact member, and has investigated how a vane can be provided with such bulging on a round top surface thereof. As a result, it has been found that when a vane is cut from a long flat bar by a shearing cutter in the thickness direction D2 in FIG. 6, the vane is subjected to pressure in the thickness direction D2 to cause bulging in a vertical direction D3 at both vertical ends of the sheared surface, and that the bulged portions should not be removed because the vanes are combined with a cam ring whose inner surface is tapered near openings thereof. The above findings lead to the low-cost production of the vane by shear cutting.

Also, experiments have shown that even when a vane having a larger bulge on its top surface than when drooping of the contact member is used, there is no trouble such as fluid leakage due to excess bulging on its top surface of the vane, as long as a long flat bar is provided with a high-precision cross section with a round tip. This means that a shear-cutting which is much more efficient and inexpensive than grinding or sawing can be utilized without necessitating a large-scale finish-grinding or trimming of bulged portions at both ends of a top surface, making the total production cost of the vanes sufficiently lower than the conventional working costs.

Thus, the vane according to the present invention is substantially in a flat rectangular parallelepiped shape having (a) two wide side surfaces opposing in the thickness direction and being slidable in each guide groove of a rotor of an actuator, (b) two narrow side surfaces opposing in the width direction, (c) an as-cold-worked top surface having an arcuately projecting cross section in a plane perpendicular to the width direction and being in slidable contact with a cam surface of the actuator for sealing, and (d) a bottom end surface opposing the top surface, both ends of said top surface in the width direction being bulging toward said cam surface.

The method for producing the above vane according to the present invention comprises the steps of:

(1) cold-working a flat bar by a roll die to provide the flat bar with substantially the same cross section as that of said vane, whereby the cold-worked flat bar has an arcuately projecting top surface with necessary precision in straightness and surface smoothness in a substantially as-cold-worked state;

(2) shear-cutting said flat bar to a predetermined length in the thickness direction, thereby causing both ends of said top surface in the width direction to bulge in a direction perpendicular to the width direction; and (3) grinding both shear-cut surfaces of the resultant vane to such an extent that as high bulging as 1–10 $\mu$m remains at both ends of said top surface.

BRIEF DESCRIPTION OF THE DRAWINGS

FIG. 1(*b*) is a vertical cross-sectional view taken along the line A—A in FIG. 1(*a*) for showing a cross section of the vane of the present invention;

FIG. 1(*c*) is a partial cross-sectional view showing one example of a bulged portion of the vane;

FIG. 1(*d*) is a partial cross-sectional view showing another example of a bulged portion of the vane;

FIG. 11(*b*) is a schematic, front view showing the cold rolling of a flat bar by a pair of grooved-surface rolls shown in FIG. 11(*a*);

FIG. 12(*b*) is a schematic, partially cross-sectional view showing the cold-drawing of a flat bar by the roll die shown in FIG. 12(*a*);

FIG. 13(*b*) is a schematic, partially cross-sectional view showing the cold-drawing of a flat bar by the roll die shown in FIG. 13(*a*).

DETAILED DESCRIPTION OF THE PREFERRED EMBODIMENTS

[1] Structure of vane

In the vane of the present invention, the extent and shape of bulging on a top surface may be determined depending on the extent and shape of the drooping (taper) of the contact member, though strict equality in extent and shape of the corresponding portions is not required. The drooping of the contact member generally has a tendency of gradual increase inside the contact member and rapid increase near an opening end of the contact member. Because the bulging of the vane by shear-cutting has substantially the same tendency as above, it is found that the shear-cut vanes can be suitably combined with the contact member having droops or tapers near their openings.

Figure 1:
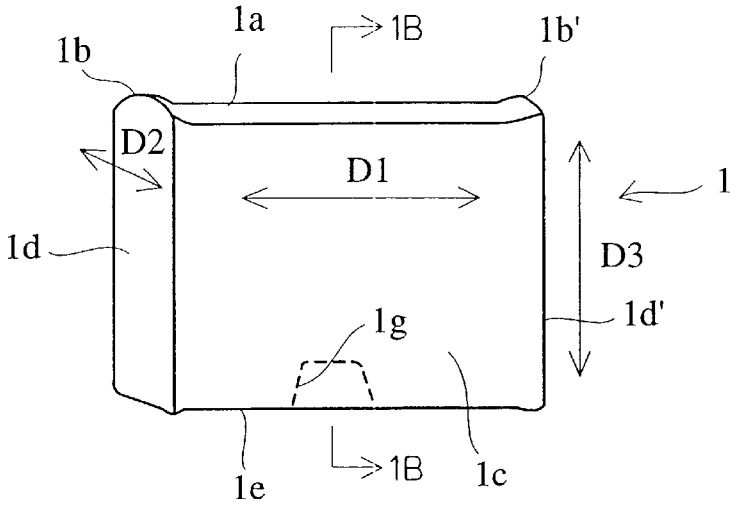
FIG. 1(*a*) is a perspective view showing a vane according to one embodiment of the present invention, in which bulged portions 1*b*, 1*b*' at both ends of a top surface 1*a* are exaggerated for the purpose of explanation.
Figure 1:
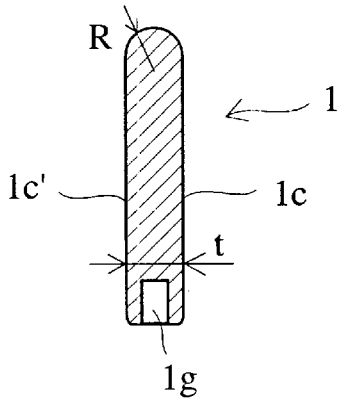
Figure 1:
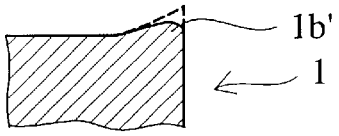
Figure 1:
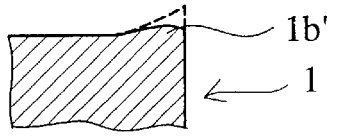

The vane according to one embodiment of the present invention will be explained referring to FIG. 1. The vane 1 is in the shape of a flat, substantially rectangular parallelepiped having a top surface 1*a*, two wide side surfaces 1*c*, 1*c*' opposing in the thickness direction D2 (perpendicular to the paper face of FIG. 1(*a*)), two narrow side surfaces 1*d*, 1*d*' opposing in the width direction D1 (parallel to the paper face of FIG. 1(*a*)), and a bottom surface 1*e* opposing the top surface 1*a*. The cross section of the vane 1 in a center portion is shown in FIG. 1(*b*). A recess 1*g* indicated by the dotted line in FIG. 1(*a*) may be provided in the bottom surface 1*e* to receive a spring, etc. Further, both narrow sides 1*d*, 1*d*' and the bottom surface 1*e* may have curved chamfers.

The top surface 1*a* has a substantially as-cold-worked surface. The term "as-cold-worked surface" means a surface of the vane which is not ground after the cold-working except for barrel-finishing, etc.

The top surface 1*a* is in the shape of an arcuate or round projection when viewed in the width direction D1 (see FIG. 1(*b*)). In one preferred embodiment shown in FIG. 1(*b*), the round top surface 1*a* has a circular cross section whose radius of curvature R may be almost equal to the thickness t of the vane 1. Both ends 1*b*, 1*b*' of the top surface 1*a* are bulged toward a contact member (upward in FIG. 1(*a*)). In FIG. 1(*a*), the height of bulging is exaggerated for illustration.

FIGS. 1(*c*) and (*d*) show examples of the bulged portions 1*b*'. In FIG. 1(*c*), the vane 1 is barrel-finished after the cold-working to remove an excess bulged portion indicated by the dotted line. In FIG. 1(*d*), the vane 1 is hand-lapped after the cold-working and then barrel-finished to remove an excess bulged portion indicated by the dotted line.

The drooping of the contact member near an opening end thereof hardly exceeds 10 μm, and it is usually 8–3 μm. The depth of drooping, namely the distance from the opening end of the contact member at which the drooping becomes substantially zero, is about 1.5 mm or less, particularly about 1.0 mm or less, usually about 0.5 mm or less. Therefore, the bulging 1*b*, 1*b*' of the vane on a top surface 1*a* is preferably to an extent to absorb the above drooping of the contact member, more preferably smaller than the drooping. Specifically, the height of bulging 1*b*, 1*b*' at both ends of the top surface 1*a* of the vane 1 may be 1–*10* μm, preferably 1–7 μm, more preferably 1–5 μm. Also, the lateral expansion of bulging, namely the distance from the end of the top surface 1*a* at which each bulging 1*b*, 1*b*' becomes substantially zero, may be about 0.3–2.5 mm or less, particularly about 0.3–1.5 mm.

With respect to the straightness of the top surface 1*a* of the vane 1, it would be no problem if the straightness is 5 μm or less for the purposes of power steering of automobiles, etc. The straightness is defined by a difference between the highest and the lowest points in an undulation of the top surface 1*a*. The straightness of the top surface 1*a* is measured by JIS B 0610. The straightness of the top surface 1*a* is smaller than the bulging, preferably 2 μm or less, more preferably 1 μm or less.

It is important that the round top surface 1*a* of the vane 1 should have as small a surface roughness as 1.0 Rz or less, particularly 0.5 Rz or less, without any bending and twisting.

[2] Production of vane

Figure 6:
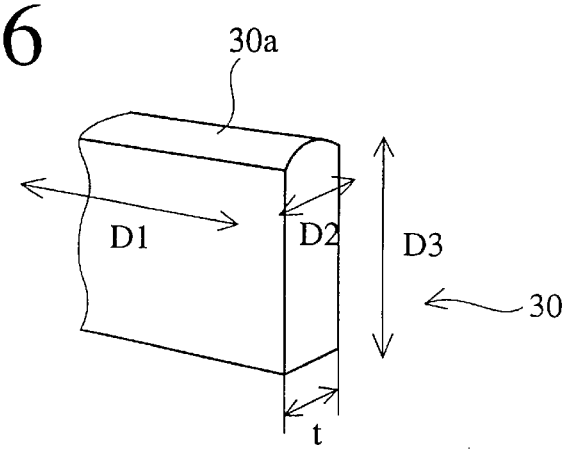
FIG. 6 is a partial perspective view illustrating a flat bar which is to be cut into vanes.

The flat bar used for the production of vanes may have a shape as shown in FIG. 6. The flat bar 30 is preferably produced by the steps of (a) hot rolling, (b) annealing, (c) removing scales from the hot-rolled bar, (d) grinding at least a surface layer of the top surface of the bar to remove defects such as a decarburized layer and scars, etc., and (e) cold-working the bar by a roll die so that the resultant flat bar 30 has exactly the same cross section as that of the desired vane 1.

[A] Materials of flat bar

When the flat bar 30 is made of high speed tool steel such as JIS G 4403 (SKH), 4404 (SKS, SKT, SKD), etc., the hardness of the flat bar is preferably 25–45 HRC to obtain a proper shape of bulging 1*b* in the top surface 1*a*. When the hardness of the flat bar 30 is less than 25 HRC, too much bulging 1*b* appears on ends of the top surface 1*a*. On the other hand, when the hardness of the flat bar 30 is more than 45 HRC, sufficient bulging 1*b* does not take place, and shear-cutting blades 28*a*, 28*b* are easily broken or wear too fast. The more preferable hardness of the flat bar 30 is 27–35 HRC.

[B] Hot rolling

The general cross section shape of the flat bar 30 is formed by a hot-rolling using a pair of grooved-surface rolls Since the hot-rolling conditions are known, their details are omitted here.

[C] Annealing

After the hot-rolling, full annealing is carried out to reduce the hardness of the hot-rolled flat bar and for normalization.

[D] Removing of scales

After the annealing, scales are removed from the surfaces of the flat bar 30 by shot blasting, etc.

[E] Grinding of top surface

Because the top surface 30*a* of the flat bar 30 should be free from defects, a surface layer of the top surface 30*a* which may be a decarburized layer, sometimes with cracks, scars, etc., should be removed by a belt grinder, etc.

[F] Cold-working of flat bar

To obtain a vane 1 having a precisely round top surface 1*a* with high straightness and small surface roughness without further finish-grinding such as creep feed grinding, the flat bar 30 is preferably provided with a cross section substantially identical with that of the finished vane 1 by cold-working using a roll die, etc. The cold-working temperature is between room temperature and 300° C.

Figure 12A:
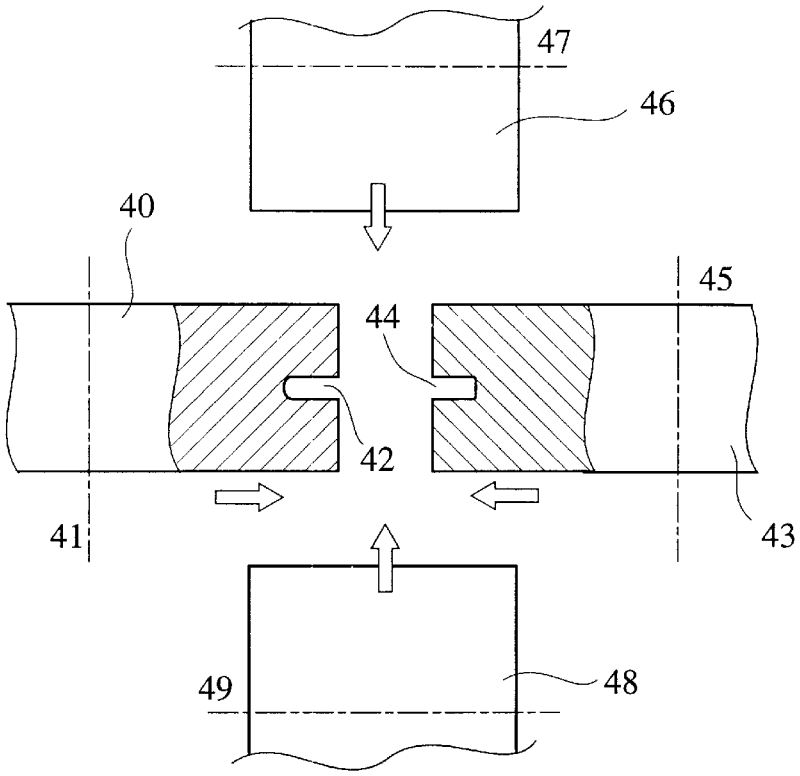
FIG. 12(*a*) is a schematic, partially cross-sectional, exploded view showing a roll die comprising a pair of grooved-surface rolls and a pair of backup rolls for cold-drawing a flat bar according to one embodiment of the present invention.
Figure 12B:
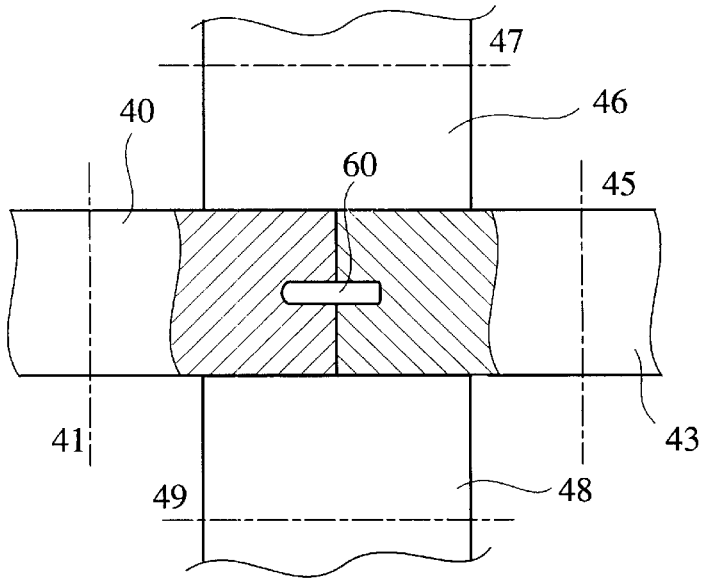

In one preferred embodiment of the present invention shown in FIGS. 12(*a*), 12(*b*), the flat bar 30 is cold-drawn by a roll die which comprises (a) a pair of grooved-surface rolls 40, 43 each rotatable around a vertical axis 41, 45 in pressed contact with each other for defining a die opening 60 through which the flat bar 30 is drawn, and (b) a pair of backup rolls 46, 48 each rotatable around a horizontal axis 47, 49 and vertically sandwiching the grooved-surface rolls 40, 43. The grooved-surface roll 40 has a groove 42 on its circumferential surface whose round bottom serves to form a round top surface 30*a* of the flat bar 30, and the grooved-surface roll 43 has a groove 44 on its circumferential surface whose chamfered bottom serves to form a bottom end surface 30*b* of the flat bar 30. Because of the round bottom of the groove 42, the round top surface 30*a* of the cold-worked flat bar 30 is provided with a high-precision round shape. The backup rolls 46, 48 exert pressure to the grooved-surface rolls 40, 43 to prevent the die opening 60 of the grooved-surface rolls 40, 43 from expanding in the course of cold-drawing, thereby providing the drawn flat bar 30 with a precise cross section.

Figure 13A:
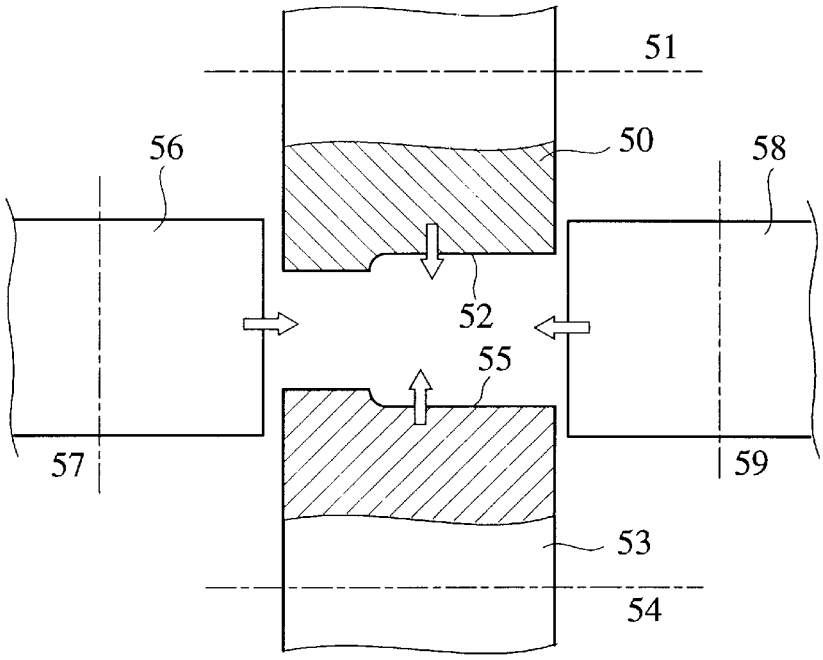
FIG. 13(*a*) is a schematic, partially cross-sectional, exploded view showing a roll die comprising a pair of grooved-surface rolls and a pair of flat-surface rolls for cold-drawing a flat bar according to another embodiment of the present invention.
Figure 13B:
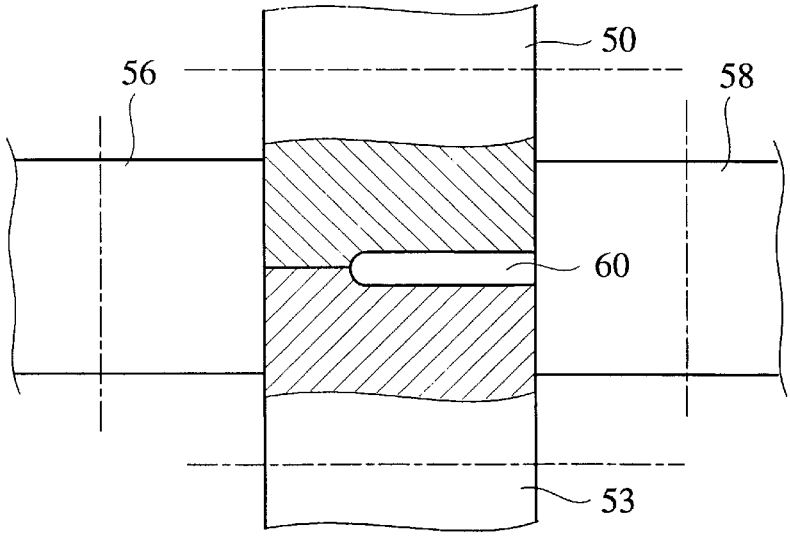

In another preferred embodiment of the present invention shown in FIGS. 13(*a*), 13(*b*), the flat bar 30 is cold-drawn by a roll die which comprises (a) a pair of grooved-surface rolls

50, 53 each rotatable around a horizontal axis 51, 54 , (b) a flat-surface roll 58 rotatable around a vertical axis 59 in pressed contact with the grooved-surface rolls 50, 53 for defining a die opening 60 through which the flat bar 30 is drawn, and (c) a backup roll 56 rotatable around a vertical axis 57. The backup roll 56 exerts pressure to the grooved-surface rolls 50, 53 and the flat-surface roll 58 to prevent the die opening 60 from expanding, thereby providing the drawn flat bar 30 with a precise cross section.

By the cold-working method using the roll die as shown in FIG. 12 or 13, the flat bar 30 is provided with a high-precision round top surface 30*a* which needs not be finish-ground after shear-cutting, and the camber of the flat bar 30 can be made within 10 mm or less per 1 m length, particularly within 5 mm or less per 1 m length.

It is also possible to decrease the surface roughness of the top surface 30*a* to as small as 1.0 Rz or less, particularly 0.5 Rz or 20 less. The twisting of the flat bar 30 is preferably within 10° or less per 1 m length, particularly within 5° or less per 1 m length.

[G] Optional heat treatment

A heat treatment such as hardening and tempering may optionally be carried out before shear cutting. In the case of high-speed tool steel such as SKH 51, for instance, the hardening conditions may be about 1200° C. for 4 minutes, and the tempering conditions may be about 750° C. for 5 minutes. The heat treatment is preferably carried out by a continuous hardening and tempering furnace to prevent the top surface 30*a* of the flat bar 30 from being scarred and to keep the straightness and surface smoothness of the top surface 30*a*.

The shape (height and depth) of bulging 1*b*, 1*b*' at both ends of the top surface 1*a* of the vane 1 can be controlled by changing the hardness of the flat bar 30 (for instance, by hardening or tempering), or by changing the shape and clearance of shear-cutting blades 28*a*, 28*b*.

[H] Shear cutting of flat bar

The cold-worked flat bar 30 is then shear-cut to a predetermined length preferably by a press cutter, etc. Finally, the round top surface 1*a* of the resultant vane 1 is ground by a grinding wheel, etc., to have a highly precise straightness and surface smoothness.

Figure 7:
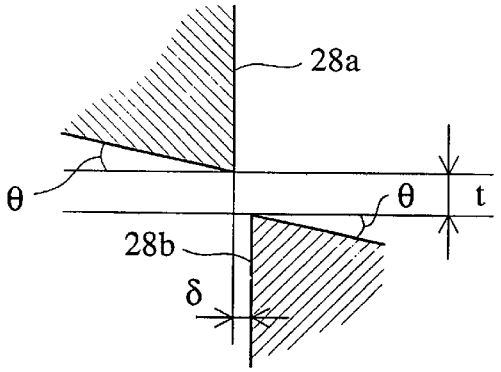
FIG. 7 is a partial cross-sectional view showing a pair of blades for shear-cutting a flat bar.
Figure 9:
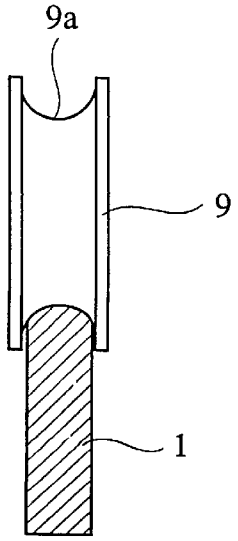
FIG. 9 PRIOR ART
FIG. 9 is a side view showing a conventional creep feed grinding wheel for grinding a round top surface of a flat bar.

The clearance δ between a pair of shear-cutting blades 28*a*, 28*b* as shown in FIG. 7 is preferably 0.2 mm or less, more preferably 0.08 mm or less, particularly 0.04–0.08 mm, when the thickness t of the flat bar 30 is about 2 mm. The shear-cutting clearance δ may change proportionally with the above level, depending on the thickness t of the flat bar 30.

The angle θ of the shear-cutting blades 28*a*, 28*b* is preferably about 5° or less, more preferably 2° or less, to alleviate the influence of wear of the shear-cutting blades 28*a*, 28*b*, and it may be 0°. When θ is 0°, the wear of the shear-cutting blades 28*a*, 28*b* is controlled preferably within 0.1 mm, particularly 0.05 mm or less from the blade edge.

[J] Heat treatment

After shear-cutting the flat bar 30, each of the resulting vanes may be heat-treated with or without rough grinding of cut surfaces.

The heat treatment of the vane may comprise a hardening step and a tempering hardening step. In the case of SKH 51, for instance, the hardening step is preferably carried out at 1210° C. in an $N_2$ gas atmosphere or in a mixed gas atmosphere of $H_2$ and an inert gas such as nitrogen, argon, etc. To prevent the vane from being scarred, it is desirable to use a tray on which the vanes 1 are less likely to collide with each other and drop therefrom. By the heat treatment, the top surface of the vane may have a hardness of about 63–66 HRC.

[K] Finish-grinding

After the heat treatment, the vane 1 is finish-ground in both narrow side surfaces 1*d*, 1*d*' and optionally in both wide side surfaces 1*c*, 1*c*'. It should be noted that the round top surface 1*a* is not ground. The bottom end 1*e* need not be ground.

To precisely keep the rectangularity of the narrow side surfaces 1*d*, 1*d*' relative to the top surface 1*a*, the grinding of the narrow side surfaces 1*d*, 1*d*' may be carried out by a method comprising the step of bringing a straight center portion of the top surface 1*a* of the vane 1 into contact with a reference surface of a jig, so that the angle of the vane 1 is regulated during grinding of the narrow side surfaces 1*d*, 1*d*'. Since the bottom surface 1*e* is precisely in parallel with the top surface 1*a*, the bottom surface 1*e* may be brought into contact with the reference surface of a jig.

Both wide side surfaces 1*c*, 1*c*' may be ground to have the desired thickness, flatness and surface roughness, though droops on these surfaces 1*c*, 1*c*' are permissible because they do not fatally affect the performance of the vane 1.

The depth of grinding in the narrow side surfaces 1*d*, 1*d*' may be minimum as long as sufficient precision is achieved. Specifically, the depth of grinding in the narrow side surfaces 1*d*, 1*d*' may be 0.1–0.3 mm.

After such finish-grinding, the vane 1 may be barrel-finished for the purposes of removing minor burrs which may remain after the finish-grinding, providing slight chamfering to corners of the vane 1, improving the smoothness of the ground surfaces, etc.

The present invention will be explained in further detail by way of the following Examples without intention of restricting the scope of the present invention thereto.

EXAMPLE 1, COMPARATIVE EXAMPLE 1

A flat bar 30 was produced from a high-speed steel (SKH51) by a hot-rolling and annealing, and scales were removed from the hot-worked flat bar 30 by shot blasting. Thereafter, a surface layer (average thickness: about 0.2 mm) of the top surface 30*a* of the flat bar 30 was removed by a belt grinder, etc.

Thereafter, the flat bar was cold-worked by a roll die shown in FIG. 12 to a cross section of 12 mm wide and 2.0 mm thick. The cold-worked flat bar 30 was shear-cut to a length of about 15 mm by a high-speed press with a shear direction aligned with the thickness direction D2. The shearing angle θ was 0°, and the wear of the blades was kept within 0.05 mm from their edges.

Next, the vane was subjected to a hardening treatment at 1210° C. and then a tempering treatment at about 540° C., such that it had a hardness of about 63 HRC. After finish grinding was conducted on the vane 1 in both wide side surfaces 1*c*, 1*c*' and both narrow side surfaces 1*d*, 1*d*', barreling was carried out. The extent of grinding was about 0.05 mm per each wide side surface 1*c*, 1*c*' and about 0.2 mm per each narrow side surface 1*d*, 1*d*'. Incidentally, the grinding of the narrow side surfaces was carried out by a rectangularity-regulated grinding method.

Figure 2:
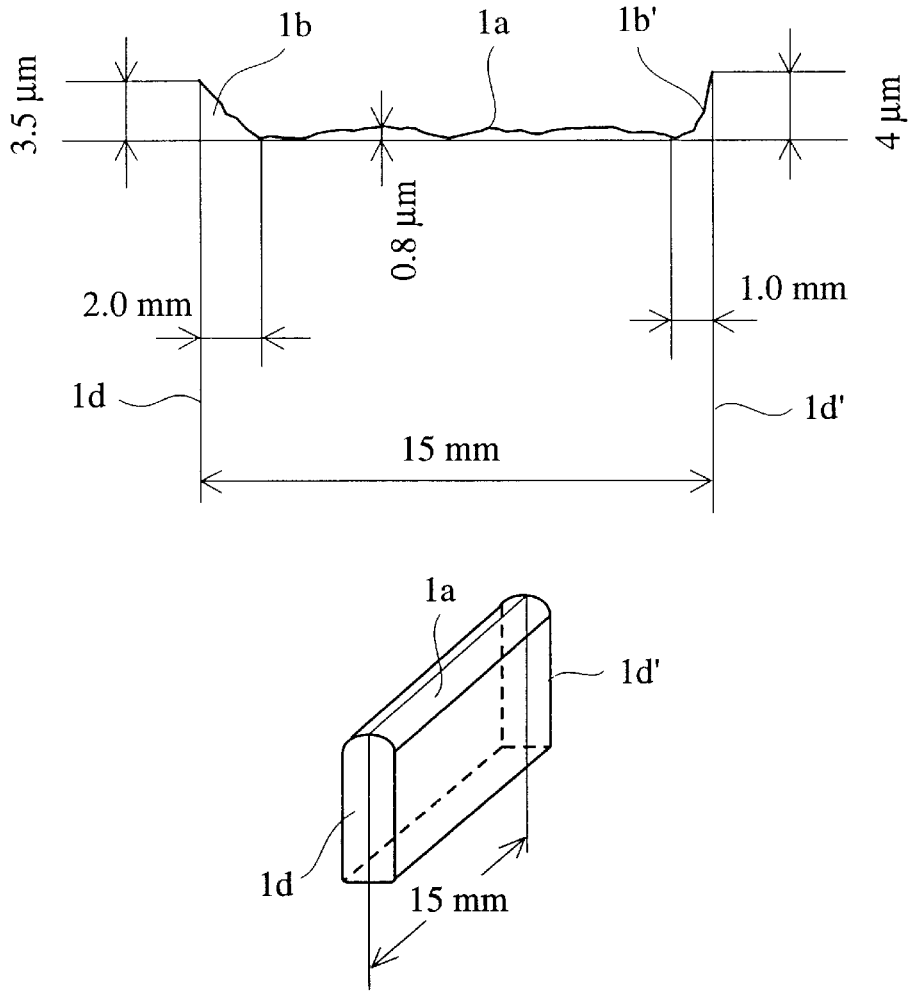
FIG. 2 is a schematic view showing the measurement method of straightness in a top surface of the vane and the measurement results of straightness before the durability test.
Figure 3:
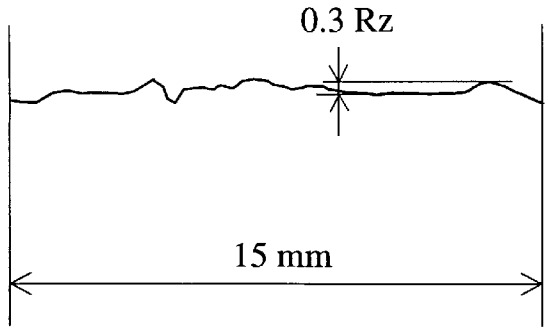
FIG. 3 is a schematic view showing the measurement results of surface roughness in a top surface of the vane before the durability test.

The resultant vane had a shape as shown in FIG. 1(*a*) in which bulged portions 1*b*, 1*b*' at both ends of the top surface 1*a* are illustrated in an exaggerated manner. The straightness and surface roughness was measured along a longitudinal center line of the top surface 1*a* of the vane 1 as shown in FIG. 2. The measurement results are shown in FIGS. 2 and 3, respectively.

It is clear from FIG. 2 that bulging was 3.5 μm in one end and 4 μm in the other end, and that 3.5 μm bulging 1*b* disappeared within 2.0 mm from the end, and 4 μm bulging 1*b*' disappeared within 1.0 mm from the end. It was also found that the top surface 1*a* was as straight as within 0.8 μm in a center portion. Also, FIG. 3 shows that the top surface 1*a* of the vane 1 was as smooth as about 0.3 Rz.

With respect to the straightness of the top surface 1*a* of the vane 1, it would be no problem if the straightness was 5 μm or less for the purpose of power steering of automobiles, etc., and the straightness may be 3 μm or less, particularly 2 μm or less.

A plurality of vanes produced by the method of Example 1 were assembled in an oil pump comprising a cam ring having a droop of about 3 μm near each opening thereof, which was then compared in durability with an oil pump (Comparative Example 1) of the same cam ring into which conventional vanes produced by the creep feed grinding were assembled. The durability test conditions are as follows:

Pressure: Repetition of 3 kgf/cm$^2$ and 100 kgf/cm$^2$;

Rotation speed: 3,000 rpm;

Oil Temperature: Constant at 120° C.; and

Total number of Rotation: 300,000.

During the durability test, the oil pump of Example 1 was operated as well as that of Comparative Example 1.

Figure 4:
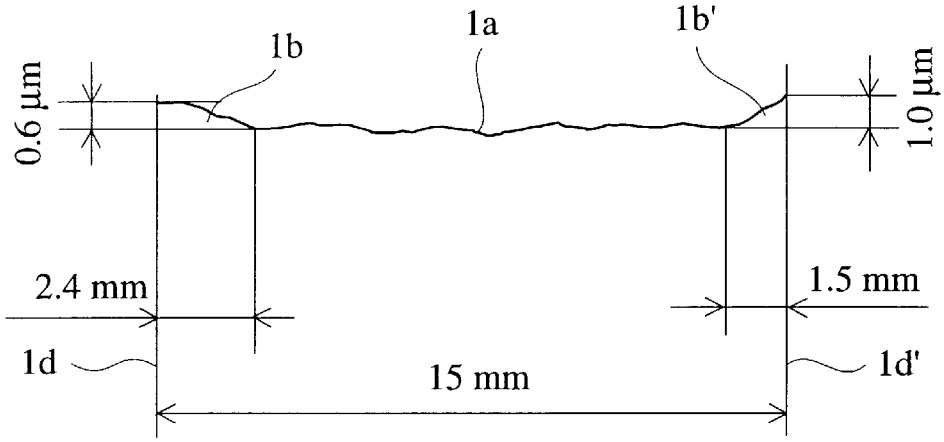
FIG. 4 is a schematic view showing the measurement results of straightness in a top surface of the vane after the durability test.
Figure 5:
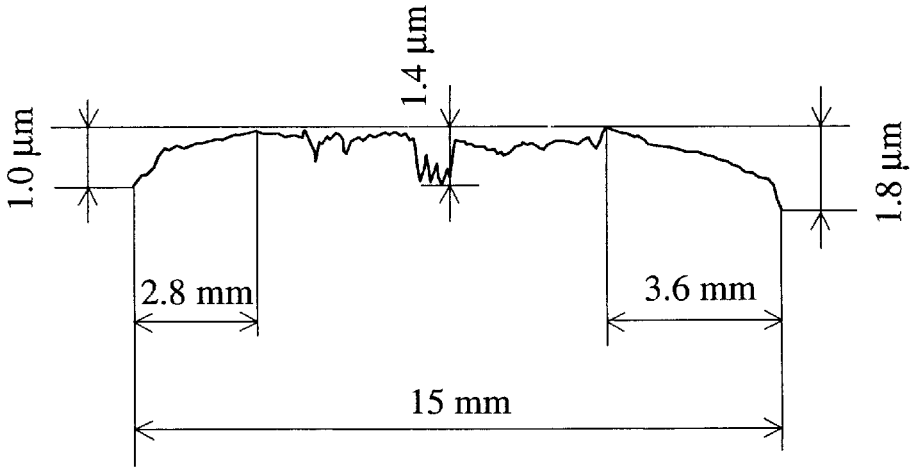
FIG. 5 is a schematic view showing the measurement results of surface roughness in a top surface of the vane after the durability test.

After the durability test, the oil pump of Example 1 was measured with respect to the straightness of the top surface of the vane 1 and the inner surface of the cam ring 13. The results are shown in FIGS. 4 and 5.

Comparing the vane 1 before the durability test (FIG. 2) with the vane 1 after the durability test (FIG. 4) in the straightness of the top surface 1*a*, it was found that the durability test reduced the bulging near the end of the top surface 1*a* from 3.5 μm and 4 μm to 0.6 μm and 1.0 μm, respectively, and that the durability test increased the lateral expansion of bulging from 2.0 mm and 1.0 mm to 2.4 mm and 1.5 mm, respectively.

Figure 10:
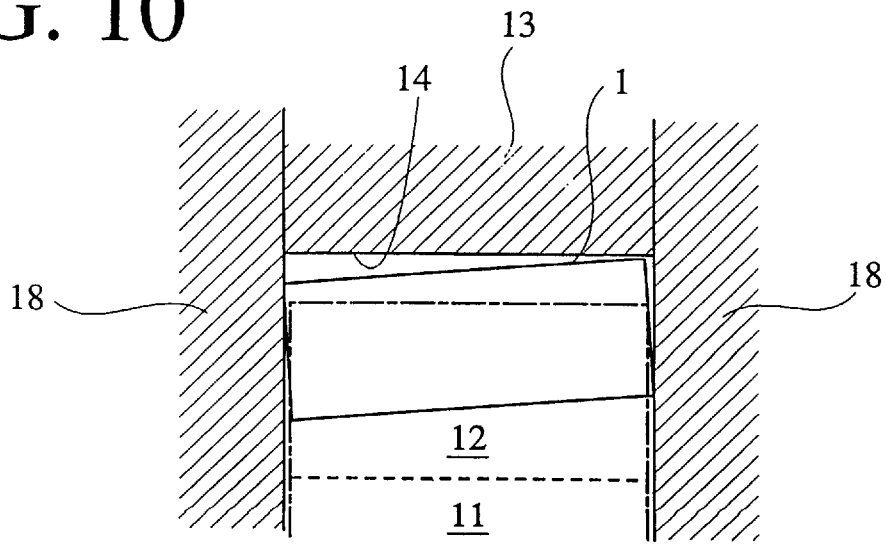
FIG. 10 is a cross-sectional view showing a presumed state of a vane in a vane pump under operation.
Figure 11A:
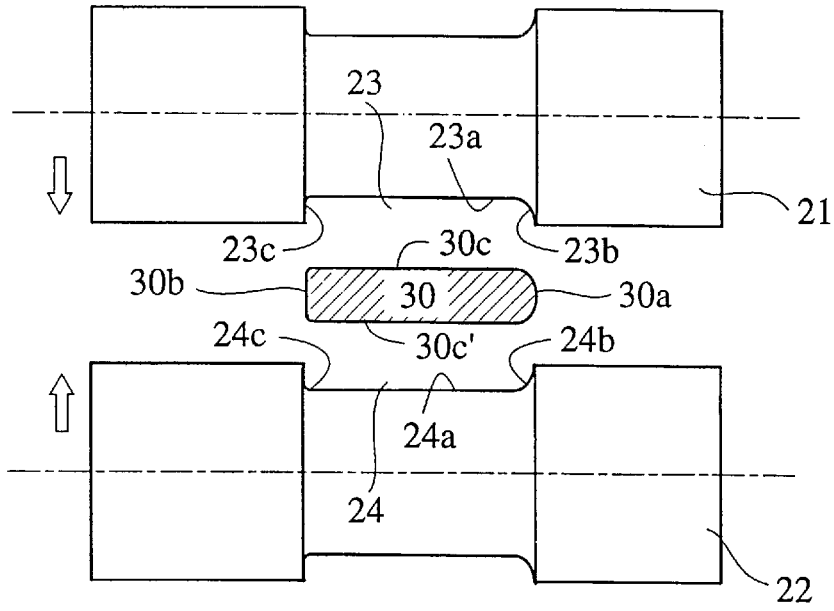
FIG. 11(a) PRIOR ART
FIG. 11(*a*) is a schematic, front view showing a pair of grooved-surface rolls for cold-rolling a flat bar.
Figure 11B:
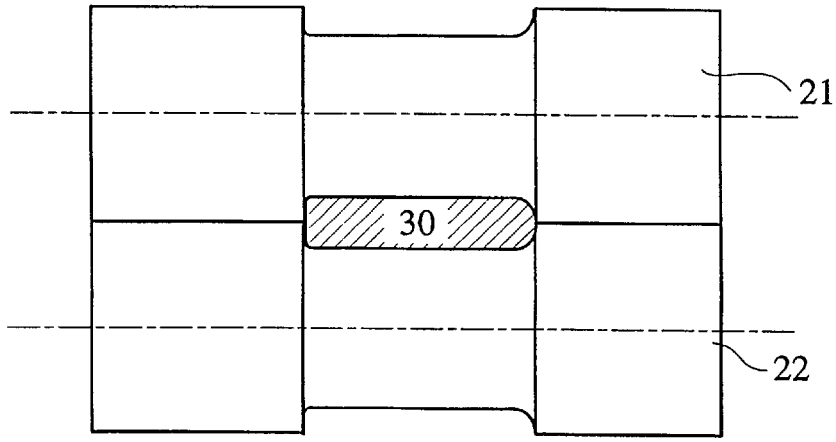
FIG. 11(b) PRIOR ART

The reason for decrease in the bulging by the durability test seems to be that the bulged portions 1*b*, 1*b*' were worn during the durability test. However, it is not known why the durability test decreased the bulging of the top surface 1*a* from 0.6 μm and 1.0 μm to lower than the droop of the cam ring (1.0 μm and 1.8 μm) and increased the depth of droop to 2.8 mm and 3.6 mm. It may be presumed that the vane 1 may sometimes be slightly inclined relative to the cam surface 14 as shown in FIG. 10 during the start and stop of the pump and in a transition from a high pressure to low pressure, etc., and that such inclination of the vane 1 in the radial groove 12 of the rotor 11 leads to the wearing of bulged portions 1*b*, 1*b*' at both ends of the top surface 1*a* of the vane 1.

As described above, high sealing is achieved between the vane of the present invention and the contact surface such as a cam surface of a cam ring, because the top surface of the vane is slightly bulged upward at both ends. Such bulging permits the contact member to have a relatively large droop, thereby increasing the productivity of the contact member and an actuator comprising such contact member. Such bulging does not affect the function of an actuator comprising the cam ring and the vanes. Accordingly, the vane of the present invention can be produced by a high-efficiency, low-cost shear-cutting method, and the finish-grinding of narrow side surfaces of the vane can be made minimum.

A cold-worked flat bar having a predetermined cross section can be shear-cut and subjected to minimum grinding in shear-cut surfaces to provide the vane of the present invention, without using expensive creep feed grinding for the top surface of the vane, thereby reducing the production cost of the vane.

Figure 8:
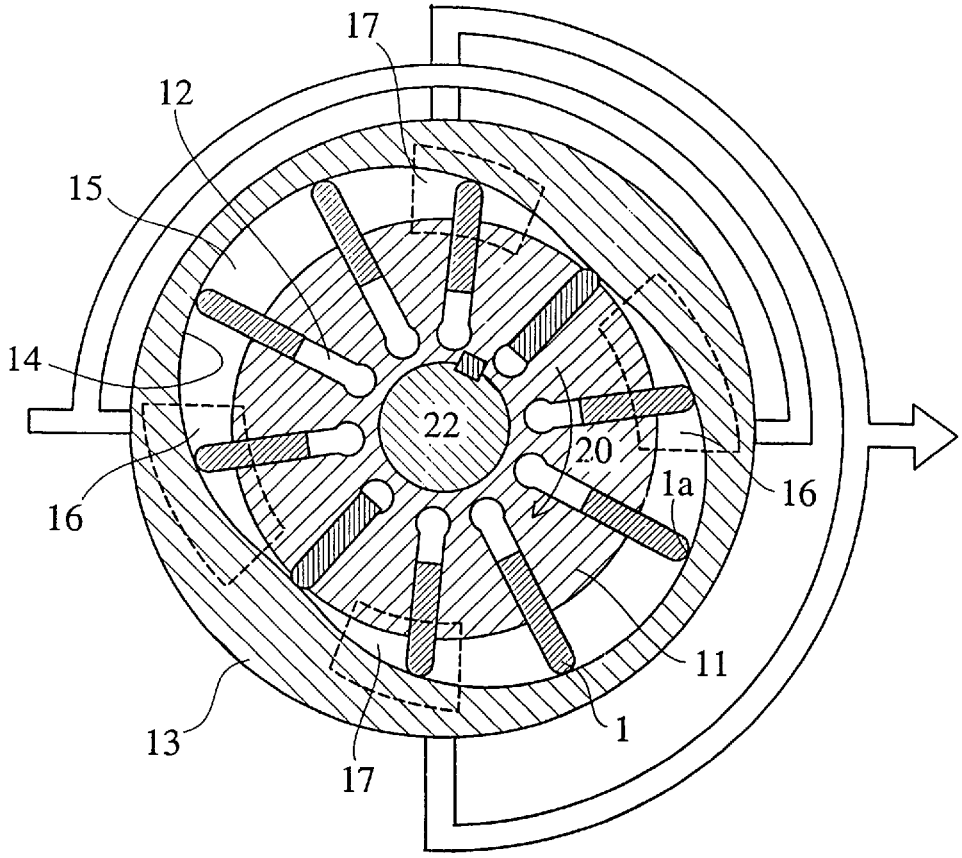
FIG. 8 PRIOR ART
FIG. 8 is a cross-sectional view showing the structure of a vane pump to which the present invention is applicable.

Though the present invention has been explained referring to embodiments shown in the attached drawings, the present invention is not restricted to them. For instance, the present invention is applicable not only to the vane actuator shown in FIG. 8 but also to other types of vane actuators, such as those having vanes in slidable contact with an outer surface of an eccentric rotor, etc. The hydraulic fluid used in such vane actuators may be a liquid such as an oil or a gas.

What is claimed is:

1. A method for producing a vane substantially in a flat rectangular parallelepiped shape having (a) two wide side surfaces opposing in the thickness direction, (b) two narrow side surfaces opposing in the width direction, (c) an as-cold-worked top surface having an arcuately projecting cross section in a plane perpendicular to the width direction, and (d) a bottom end surface opposing the top surface, both ends of said top surface in the width direction being bulging in a direction perpendicular to the width direction, comprising the steps of:

(1) cold-working a flat bar by a roll die to provide the flat bar with substantially the same cross section as that of said vane, whereby the cold-worked flat bar has an arcuately projecting top surface with necessary precision in straightness and surface smoothness in a substantially as-cold-worked state;

(2) shear-cutting said flat bar to a predetermined length in the thickness direction, thereby causing both ends of said top surface in the width direction to bulge in a direction perpendicular to the width direction; and (3) grinding both shear-cut surfaces of the resultant vane to such an extent that as high bulging as 1–10 μm remains at both ends of said top surface.

2. The method for producing a vane according to claim 1, wherein said roll die comprises (a) a pair of grooved-surface rolls each rotatable around a vertical axis in pressed contact with each other for defining a die opening through which said flat bar is drawn, and (b) a pair of backup rolls each rotatable around a horizontal axis and vertically sandwiching said grooved-surface rolls, whereby said backup rolls exert pressure to said grooved-surface rolls to prevent said die opening from expanding, thereby providing the drawn flat bar with a precise cross section.

3. The method for producing a vane according to claim 1, wherein said roll die comprises (a) a pair of grooved-surface rolls each rotatable around a horizontal axis, (b) a flat-surface roll rotatable around a vertical axis in pressed contact with said grooved-surface rolls for defining a die opening through which said flat bar is drawn, and (c) a backup roll rotatable around a vertical axis and pressing said grooved-surface rolls and said flat-surface roll to prevent said die opening from expanding, thereby providing the drawn flat bar with a precise cross section.

4. The method for producing a vane according to claim 1, wherein said flat bar has a hardness of 25–45 HRC before shear-cutting.

5. The method for producing a vane according to claim 4, wherein the cold-worked flat bar has a camber of 5 mm or less per 1 m length and a surface roughness of 1.0 Rz or less.

* * * * *